US005495943A

United States Patent [19]

Bienaime

[11] Patent Number: 5,495,943

[45] Date of Patent: Mar. 5, 1996

[54] CLOSED PACKAGE FOR OBJECTS

[75] Inventor: Patrick Bienaime, Milly sur Therain, France

[73] Assignee: 4 P Emballages France, Beauvais Cedex, France

[21] Appl. No.: 273,106

[22] Filed: Jul. 8, 1994

[30] Foreign Application Priority Data

Jul. 9, 1993 [FR] France ..... 93 08493

[51] Int. Cl.[6] ..... B65D 75/28; B65D 5/32

[52] U.S. Cl. ..... 206/427; 229/23 BT

[58] Field of Search ..... 206/427, 428, 206/434; 229/23 R, 23 BT

[56] References Cited

U.S. PATENT DOCUMENTS 3,810,573 5/1974 Russell et al. ..... 229/23 BT X
4,715,493 12/1987 Dreyfus ..... 206/427 X
4,817,797 4/1989 Hamelin ..... 206/428
4,848,651 7/1989 Hartness ..... 229/23 BT X
4,871,067 10/1989 Valenti ..... 206/427

*Primary Examiner*—Bryon P. Gehman
*Attorney, Agent, or Firm*—Michael J. Striker

[57] ABSTRACT

A closed package for grouping a plurality of objects such as beverage containers comprises a first part having a central zone defining a horizontal wall and two other zones defining first and second generally vertical opposite walls, a second part which is separate from the first part and has a central zone defining another horizontal wall and two other zones defining third and fourth generally vertical opposite walls and connecting the first generally vertical wall to the second generally vertical wall in assembled condition, and a locking element provided in the region of two opposite ends of one of the parts and in the central zone of the other of the parts and locking the parts with one another.

16 Claims, 4 Drawing Sheets

CLOSED PACKAGE FOR OBJECTS

BACKGROUND OF THE INVENTION

The present invention relates to packages made for example from cardboard or similar materials and used for grouping together a plurality of beverage containers such as bottles.

The grouping of bottles, particularly beer bottles, poses particular problems. In order to prevent degradation of the product in time, it is necessary to group bottles in an entirely closed outer cardboard package. The conventional method of making such a closed package or carton, commonly called a "small case" includes starting with a single blank of folded and pre-pasted cardboard, putting the blank into a desired shape, placing the contents in the shaped package and then completing the putting into shape and fixing various fixing parts of the blank together. This technique requires the use of extremely complex and expensive machines. Furthermore, it requires pasting of several parts, particularly side parts. It is preferable to use locking tongues which are much easier to handle and more economical, since it is not necessary to provide a paste application device on the machine. It is advisable to further improve the construction of such closed packages in many aspects.

SUMMARY OF THE INVENTION

Accordingly, it is an object of the present invention to provide a new cardboard grouping package of a small case type, which is economical, easy to put into shape, and requires no pasting.

In keeping with these objects and with others which will become apparent hereinafter, one feature of the present invention resides, briefly stated, in a closed package for grouping a plurality of objects such as beverage containers, which has a first part with a central zone defining a horizontal wall and two other zones defining first and second generally vertical opposite walls, a second separate part having a central zone defining another horizontal wall and two other zones defining third and fourth generally vertical opposite walls and connecting the first generally vertical wall with the second generally vertical wall, and locking means provided in two opposite ends of one of the parts and in the central zone of the other of the parts for locking the parts with one another.

When the package is designed in accordance with the present invention, it provides for the above mentioned highly advantageous results in forming a package which is economical, easy to put into the shape, and requires no pasting.

In accordance with a further feature of the present invention the central zone of the first part constitutes a bottom wall of the package, and its second part has two zones extending below and long the bottom wall and having locking tabs capable of cooperating with locking openings formed in the bottom wall; the bottom wall is bordered by two flaps extending internally against the base of the third and fourth generally vertical walls; the first and second generally vertical walls are bordered by flaps extending internally against the lateral edges of the third and fourth generally vertical walls; each generally vertical wall has a lower zone and an upper zone inclined in a re-entrant direction with respect to the lower zone, and the flaps bordering the first and second generally vertical walls each comprise a first flap and a second flap separated by a generally triangular compensation zone located at the height of the transition between the said lower and upper zones; the flaps bordering the first and second generally vertical walls each halve at an intermediate height a locking opening intended to interact with a respective arrangement formed on the second part of the package in the vicinity of the third or fourth generally vertical wall; the central zone of the second part constitutes a top wall of the package, this top wall is bordered by two flaps forming front panels, the third and fourth generally vertical walls are bordered at least partially by flaps for holding the front panels folded internally against the third and fourth generally vertical walls, generally triangular intermediate zones are provided between the flaps forming front panels and the flaps for holding the front panels, and the arrangements with which the openings interact each comprise a protruding tab extending from a respective intermediate zone; each protruding tab is defined by a broken cut-out line extending between an oblique folding line separating the associated front panel-holding flap from the intermediate zone and a free edge of the said second part of the package; each opening intended to interact with a protruding tab is delimited by a straight edge extending generally parallel with the oblique folding line; each opening is also delimited by a straight edge extending in alignment with a folding line by which the flap comprising the opening is articulated on the associated part of generally vertical wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
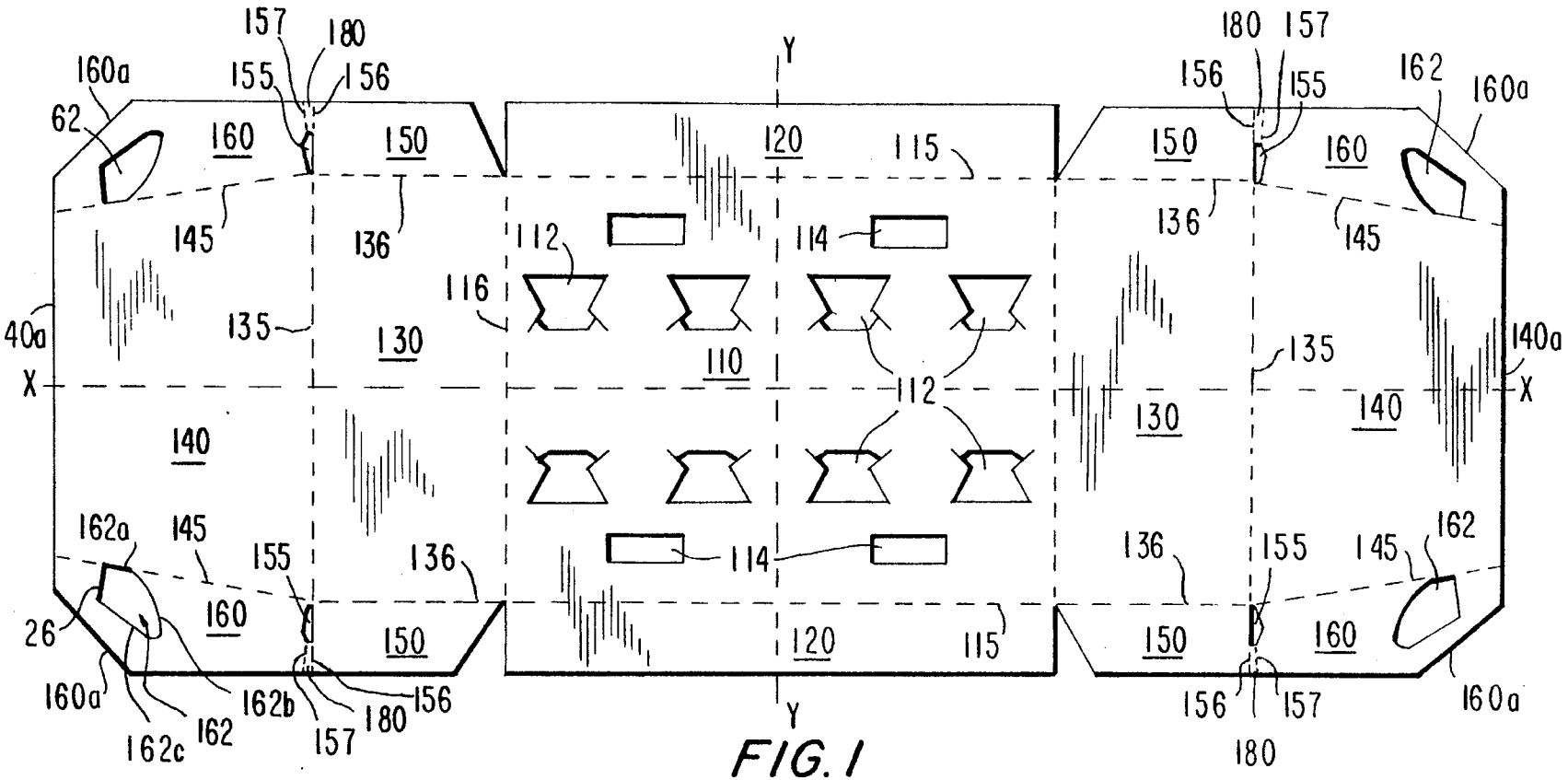
FIG. 1 is a plan view of a cardboard blank for producing a first part of a package according to the invention.
Figure 2:
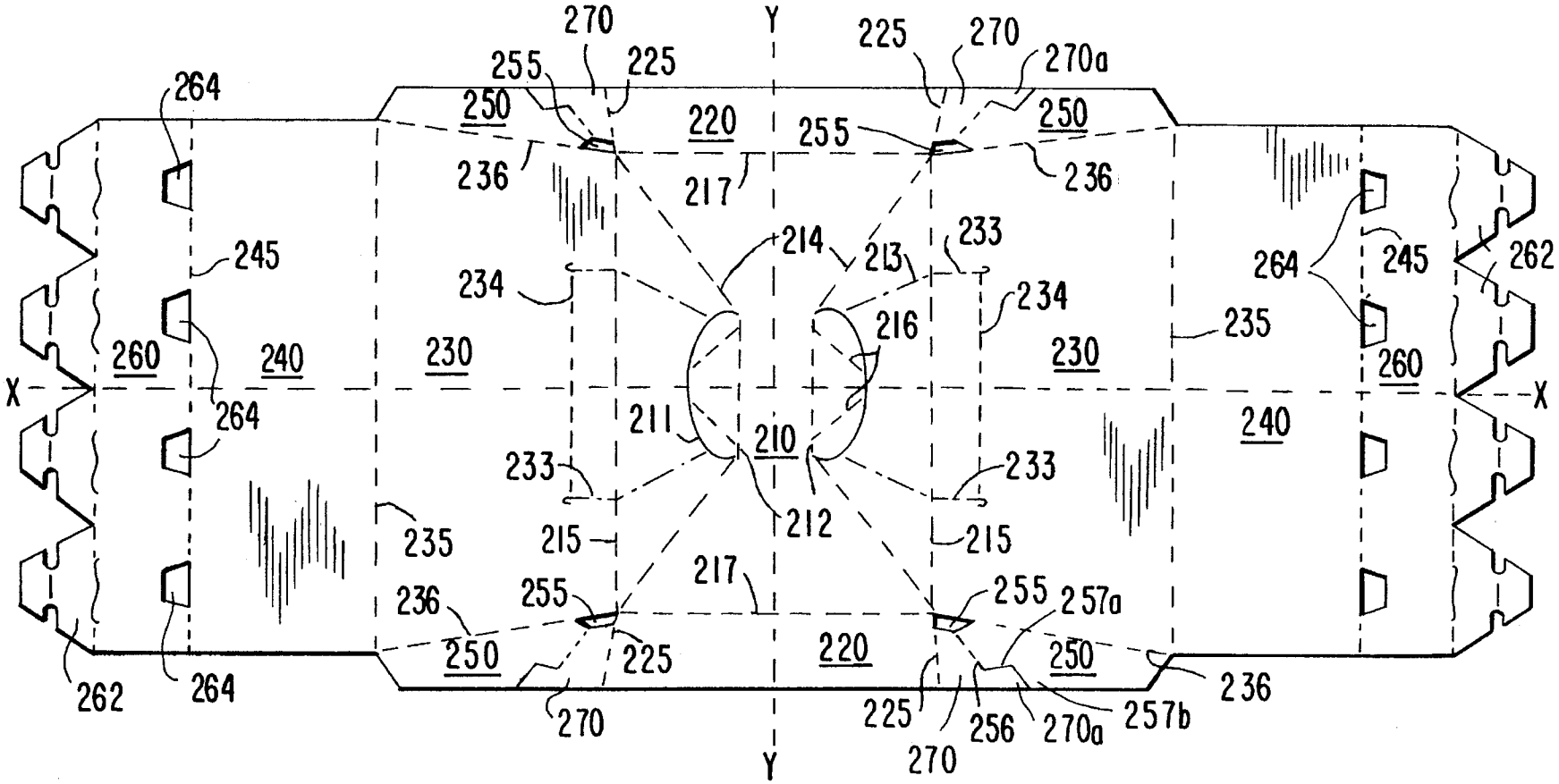
FIG. 2 is a plan view of a cardboard blank for producing a second part of the package according to the invention.

A package in accordance with the present invention is made actually from two blanks which are shown in FIGS. 1 and 2 and interact with one another to form a closed package. Each of the blanks is symmetrical with respect to a central longitudinal axis x—x and also with respect to a central transverse axis y—y. For purposes of simplification, only one part of each blank will be described in detail, in particular the north-west quarter in the drawings, while the other parts can be derived from the previously mentioned symmetry and the same parts or elements are denoted by the same reference numerals.

it should also be noted that various shapes, dimensions and orientation shown in FIGS. 1 and 2 should be considered as being an integral part of the present description and the blanks of FIGS. 1 and 2 are shown to the same scale.

The blank 100 shown in FIG. 1 has a central main bottom zone 110 defining bottom wall of the package. The central main zone has two rows of four locking openings 112 intended to interact with locking tabs of the other blank. The individual locking tabs/opening pairs are conventional and will not be described in detail. They may be of course replaced by other equivalent non-pasted locking means.

The bottom zone 110 also has four openings 114 of rectangular shape, which are arranged outside the two rows of the openings 112 and intended for driving the blank with fingers or similar when producing the package on a machine. The bottom zone 110 is laterally bordered by two rectangular flaps 120 having the same length. The bottom zone 110 and the flaps 120 are connected with one another along folding lines 115.

In the longitudinal direction, the bottom zone 110 is bordered by two zones forming frontal walls. Each of these zones has a first part 130 adjacent to the zone 110 and intended to form a lower vertical part of a frontal wall, and a second part 140 intended to form an upper part of the frontal wall, slightly inclined in a re-entrant direction with respect to the vertical so as to closely follow the neck region of bottles to be grouped in the package. The zone 110 is connected to each zone 130 by a folding line 116, while each zone 130 is connected to the adjacent zone 140 by a folding line 135. The folding lines 115 are parallel with each other and with the longitudinal direction of the blank. The folding lines 116 and 135 are also parallel with each other and perpendicular to the longitudinal direction of the blank.

Two side flaps 150, 160 border each side of the parts 130, 140. The flaps 150 are connected with the zones 130 by folding lines 136 which extend in the longitudinal direction of the blank. The flaps 160 are connected with the zones 140 by the folding lines 145 which are slightly inclined toward the interior with respect to the longitudinal direction of the blank, starting from zones 130.

An opening 155 having generally oblong shape is provided at the transition between each pair of the flaps 150, 160. It extends over a portion (approximately half) of the width of the flaps starting from the end adjacent to the corresponding folding line 135. Each opening 155 is extended toward the free edge of the flaps 150, 160 by two folding lines 156, 157. One folding line 156 delimits the flap 150 and extends essentially in the prolongation of the associated folding line 135, while the other folding line 157 delimits the flap 160 and extends with a slight diverging inclination with respect to the line 156. The opening 155 and the folding lines 156, 157 delimit a compensation zone 180 for the purposes explained below.

The inclination of the folding lines 145 determine the re-entrant inclination of the parts 140 of the frontal walls after putting the package into shape.

On the side opposite the associated zone 180, each flap 150 is terminated by an edge which is oblique with respect to the adjacent straight edge of the flap 120. On the side opposite the associated zone 180, each flap 160 has a chamfered edge **160*a* which joins the extreme edge 140*a* of the blank in the longitudinal direction at a point offset toward the interior with respect to the point at which the folding line 145 joins the edge 140*a***.

Each flap 130 has a locking opening 163 in its region opposite the compensation zone 180. The locking opening is delimited by a straight line **162*a* which is collinear with the associated folding line 145, by a straight edge 162*b* which is perpendicular to the folding line 145 by a straight edge 162*c* extending essentially along the chamfered edge 160*a*, and finally by a generally curved edge 162*d* connecting the straight edges 162*a* and 162*c***. Of course, the openings can have different shapes as well.

A second blank 200 which is used in association with the first blank 100 to form a closed package in accordance with the present invention is shown in FIG. 2. The blank 200 has a central part 210 which forms a top wall of the package. The central or top part 210 is provided in its central region with cut-out lines 211 which are shaped like portions of ellipses, articulated above transverse folding lines; 212 and delimit flaps which can be pushed down toward the inside of the package to facilitate grasping the latter. Two folding lines 216 are formed in the flaps convergent with the articulating folding lines 212 toward the cut-out line 211. When the above mentioned pushing-down is carried out, the flaps make possible by folding to prevent the tops of the containers from being an obstacle to the pushing-down.

Oblique pre-cut lines 213 extend in a divergent manner towards the transverse edges of the top zone 210 starting from the pre-cut lines 211. These pre-cut lines 213 make it possible to open the package in order to extract the containers which it contains. Folding lines 214 extend starting from the four corners of the part 210 in the direction of the homologous free ends of the cut-out lines 211. Their purpose is to optimize the distribution of stresses when the loaded package is grasped by the handle defined between the pushed-down flaps, and in particular to prevent any initiation of tearing the cardboard in the region of the flaps.

The central part is laterally bordered by two flaps 220 connected to the said central part by parallel folding lines 217 extending in the longitudinal direction y—y of the blank 200. On either side of the central part 210 in the longitudinal direction there are provided zones intended to form side walls of the package. Each zone has a first part 230 and a second part 240. Each part 240 defines a lower vertically oriented region of the side wall, whilst each part 230 defines an upper region of the side wall slightly inclined in a re-entrant manner in order to closely follow the neck part of the containers. Transverse folding lines 215 separate the part 210 from the adjacent parts 230. Transverse folding lines 235 separate the parts 230 from the respective parts 240.

Each part 230 has pre-cut lines 233 oriented longitudinally and extending the pre-cut lines 213 of the top wall 210. The free ends of these pre-cut lines 233 are connected to each other by a respective folding line 234 extending in the transverse direction. Each part 230 is laterally bordered by two respective flaps 250. Folding lines 236 separate each part 230 from the adjacent flaps 250. These folding lines 236 extend slightly obliquely and towards the exterior starting from the ends of the folding lines 217. In the region of each flap 250 close to the adjacent corner of the top part 210 a quadrilateral opening 255 is formed. Its one straight edge is aligned with the folding line 236 and its other straight edge is aligned with a folding line 225 which is slightly oblique towards the exterior and delimits the respective side flap 220.

A folding line 256 extends starting from the corner located between the two other straight edges of the opening 255 approximately over the bisectrix between the adjacent folding lines 225 and 236. This folding line does not extend up to the free longitudinal edge of the flap 250. It is extended by a cut-out line including a first straight section **257*a* oriented in a re-entrant manner towards the opposite end of the adjacent flap 250, and by a second straight section 257*a* to the free end of the said straight section 257*a* to the free longitudinal edge of the adjacent flap 250 and having an orientation slightly closer to the transverse direction than the folding line 256**.

Each opening 255, in association with the respective folding line 256 and cut-out line 257*a*, 257*b* constitutes the separation between the adjacent flap 250 and a zone of complex shape 270. This zone 270 i separated from the adjacent side flap 220 by the folding line 225 described above. At the end opposite the zone 270, each flap 250 is terminated by an oblique edge joining the corresponding end of the folding line 235. Each part 240 is rectangular and has no side flaps.

Finally the blank of FIG. 2 respectively has, in the region of its two longitudinal ends, two parts 260 intended to form bottom walls of the package, covering the bottom wall 110 of the other blank as will be described below. Transverse folding liens 245 separate each part 240 from the adjacent part 260. Each part 260 has, protruding towards the exterior in the longitudinal direction, a plurality of locking tabs 262, there being four of them in this case, of generally trapezoidal shape intended to interact with the openings 112 of the blank of FIG. 1. Furthermore, along each folding line 245 there are formed, in the associated part 260, four trapezoidal openings 264 intended in particular for facilitating the folding of the blank along the folding lines 245.

Figure 5:
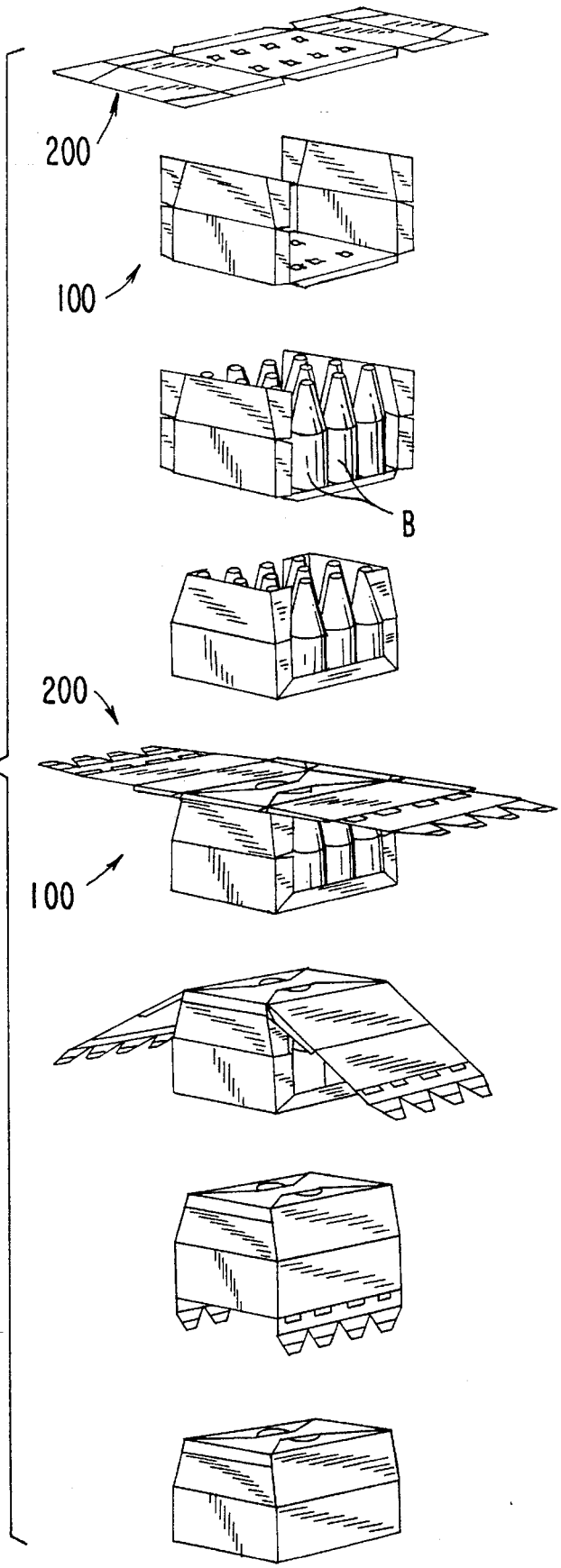
FIG. 5 is a diagrammatic illustration of various steps of putting the package according to the invention into shape.

A closed package in accordance with the present invention is produced from the above described two blanks as shown in FIG. 5.

Firstly during the putting into shape, the blank 100 is placed flat in a conveying unit capable of positioning twelve bottles B, in three rows of four, on the bottom part 110. These rows are oriented in the longitudinal direction of the blank 100. Before the positioning of the bottles, the frontal walls 130, 140 of the blank 100 are folded upwards at 90°. After the positioning of the bottles the flaps 150, 160 and 120 are folded at 90° against the bottles. The blank 200 is positioned above the blank 100 in such a way that its longitudinal direction y—y is perpendicular to the longitudinal direction x—x of the blank 100, and its central part 210 rests on the tops of the bottles. The upper wall parts 140 have previously been slightly folded towards the interior in order to follow the necks of the bottles, the angle between each part 130 and the adjacent part 140 being slightly less than 180°. During this movement, a folding of the lines 156, 157 occurs in order to form a Z-shaped profile with, finally, a superimposition of zones 180 and of the adjacent regions of the flaps 150, 160. The blank 100 thus put into shape is ready to interact with the blank 200, put into shape by the following steps: the aligned flaps 220, 250 are folded at least partially downward and, while they are held in this position, the parts 230, 240 forming side walls are folded against the open sides of the blank 100. By means of the oblique folding line 256 of each zone 270, the Z-shaped folding of the material about the folding lines 225, 256 is assisted in these regions in order, finally, to bring the zones 270 and the adjacent regions of the flaps 220, 250 against one another. During this movement, each section of cardboard delimited by the cut-out lines 257*a*, 257*b* defines a locking tab 270*a* which temporarily protrudes towards the interior of the carton by extending through a respective opening 162 of the blank 100 which is facing it. At the end of this operation, each flap 250 and each associated zone 270 has been folded against the interior of the side wall part 230, and the cardboard part located between the chamfered edge of each flap 160 and the adjacent straight edge 162*c* of the opening 162 is trapped between the locking tab 270*a* and the inside face of the respective side wall part 230.

Holding in this position is ensured by the neck regions of the bottles and mutual locking is obtained in this way at an intermediate height between the top and the bottom defined by the position of the locking tabs 270*a* and therefore of the cut-out lines 257*a*, 257*b* between the upper parts 140, 230 of the frontal walls and of the side walls respectively. The risk of gaping between these walls once the package is completed is minimized in this way. The package is furthermore reinforced by rendering a tearing of the cardboard in these regions in order to extract the bottles more difficult. At the same time, the flaps 250 and the zones 270 ensure the holding of the flaps 220 in place in a position inclined slightly less than 90° downwards with respect to the plane of the top zone 210. These flaps 20 thus constitute upper front panels which in turn have the function of holding the frontal walls 130, 140 by acting at the level of their upper regions.

The last stop of putting the package into shape consists, once the side wall parts 230, 240 have been positioned against the bottles (with substantially the same mutual inclination as the frontal wall parts 130, 140, in folding the zones 260 of the blank 200 below the bottom zone 110 of the blank 100 and in carrying out the final locking of the package by means of the tabs 262 and the openings 112. Once the final locking is complete,t he side walls 230, 240 ensure the holding of the flaps 120, 150, 160 of the blank 100, which extend internally against the said side walls. It is of course possible to envisage variants of this putting into shape, it being possible, for some of them, to modify the order of operations described above.

Figure 3:
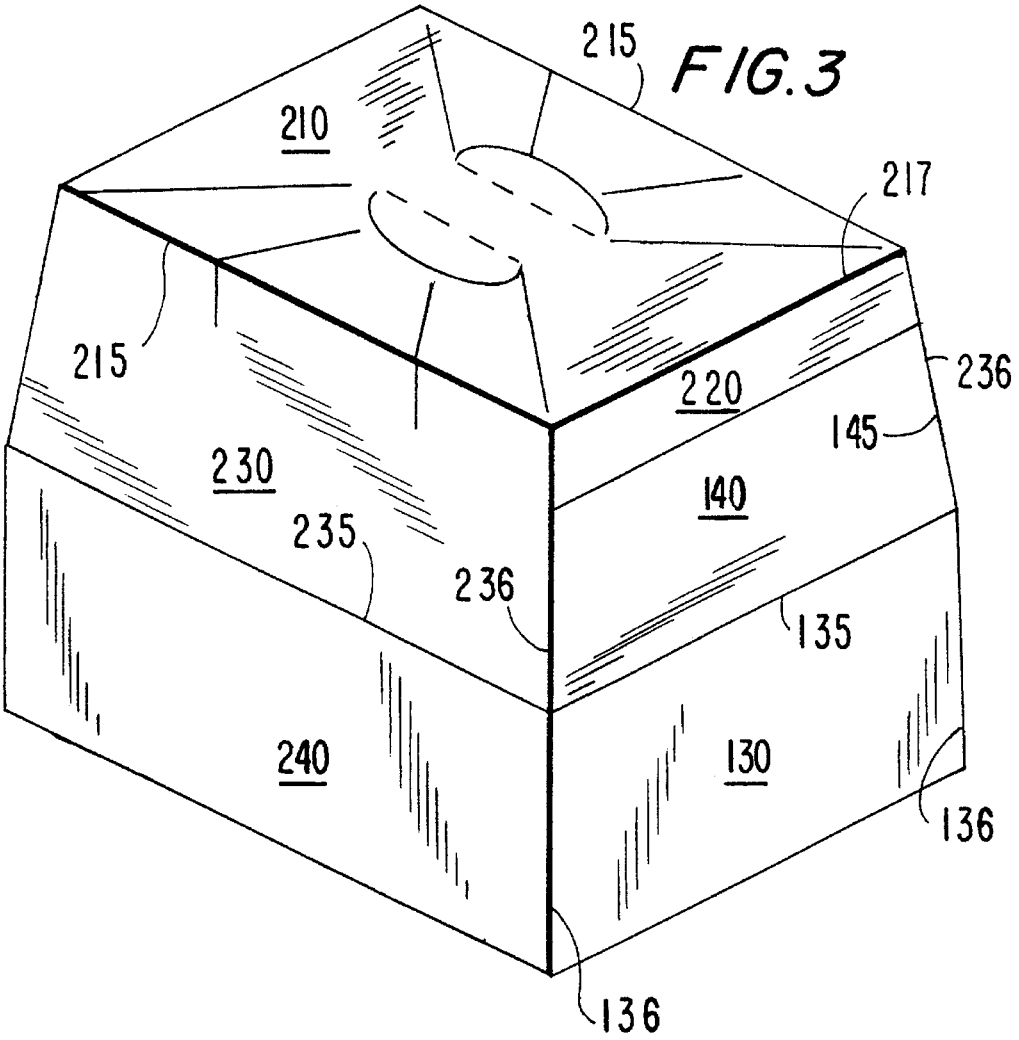
FIG. 3 is a diagrammatic perspective view of the complete closed package produced.

FIG. 3 is a diagrammatic representation of the shape of the package finally obtained. It is observed that all of its surfaces are generally smooth, which is particularly advantageous from the aesthetic point of view.

Figure 4:
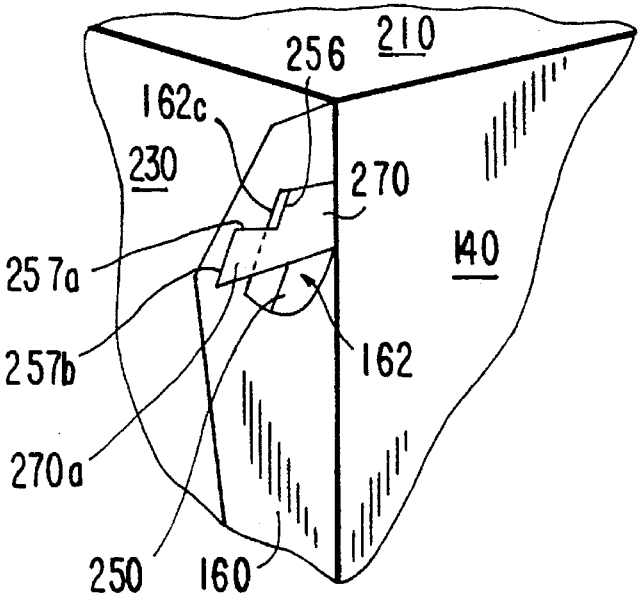
FIG. 4 is a perspective view of a detail of the package of FIG. 3.

FIG. 4 shows, in a perspective view of the interior, the cooperation between a flap 160 in the region of its opening 162 and a zone 170 and the associated flaps to ensure the above mentioned locking between side wall and frontal wall at an intermediate height. It is observed that after the putting into shape, the oblique folding line 256 extends generally parallel with the straight edge 162*c* of the opening 162.

It will be noted that the folding lines mentioned throughout the preceding description may consist, in concrete terms, of grooved lines, notched lines, etc.

It will be understood that each of the elements described above, or two or more together, may also find a useful application in other types of constructions differing from the types described above.

While the invention has been illustrated and described as embodied in a closed package for objects such as beverage containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed and desired to be protected by Letters Patent is set forth in the appended claims.

1. A closed package for grouping a plurality of objects, comprising a first part having a central zone defining a horizontal wall and two other zones defining first and second generally vertical opposite walls; a second part which is separate from said first part and has a central zone defining another horizontal wall and two other zones defining third and fourth generally vertical opposite walls and connecting said first generally vertical wall to said second generally vertical wall in assembled condition; and locking means provided at two opposite ends of one of said parts and in said central zone of the other of said parts and locking said parts with one another, said central zone of said first part forming a bottom wall of the package, said second part having two further zones extending below and along said bottom wall, said locking means including locking openings formed in said bottom wall and locking tabs provided in said two further zones and cooperating with said locking openings.

2. A closed package as defined in claim 1, wherein said first part has two flaps which border said bottom wall and extend internally against a base of said third and fourth generally vertical walls.

3. A closed package as defined in claim 1, wherein said first part has flaps which border said first and second generally vertical walls and extend internally against lateral edges of said third and fourth generally vertical walls.

4. A closed package as defined in claim 3, wherein said zones of said first part include a lower zone and an upper zone inclined in a re-entrant direction with respect to said lower zone, said flaps bordering said first and second generally vertical walls, each of said flaps having a first flap and a second flap separated by a generally triangular compensation zone located at a height of a a transition between said lower and upper zones.

5. A closed package as defined in claim 1, wherein said locking means including a locking opening provided each of said flaps bordering said first and second generally vertical walls at an intermediate height, and an arrangement formed on said second part of the package in the vicinity of said third and fourth generally vertical walls and cooperating with said locking openings.

6. A closed package as defined in claim 5, wherein said central zone of said second part forms a top wall of the package, said second part having two flaps bordering said top wall and forming front panels and two further flaps bordering at least partially said third and fourth generally vertical walls for holding said front panels folded internally against said third and fourth generally vertical walls, said second part also having generally triangular intermediate zones formed between said flaps forming front panels and said further flaps holding said front panels and interacting with said locking openings, said arrangement having a protruding tab extending from a respective intermediate zone.

7. A closed package as defined in claim 6, wherein each protruding tab is defined by a broken cut-out line extending between an oblique folding line separating an associated one of said further flaps which hold said front panels from said intermediate zone and a free edge of said second part of the package.

8. A closed package as defined in claim 7, wherein each of said locking openings interacting with said protruding tab is delimited by a straight edge extending generally parallel to said oblique folding line.

9. A closed package as defined in claim 8, wherein each of said locking openings is also delimited by a straight edge extending in alignment with a folding line by which said flap bordering said first and second generally vertical walls and having said locking opening is articulated on an associated part of a respective one of said generally vertical walls.

10. A closed package for grouping a plurality of objects, comprising a first part having a central zone defining a horizontal wall and two other zones defining first and second generally vertical opposite walls; a second part which is separate from said first part and has a central zone defining another horizontal wall and two other zones defining third and fourth generally vertical opposite walls and connecting said first generally vertical wall to said second generally vertical wall in assembled condition; and locking means provided at two opposite ends of one of said parts and in said central zone of the other of said parts and locking said parts with one another, said first part having flaps which border said first and second generally vertical walls and extend internally against lateral edges of said third and fourth generally vertical walls, said locking means including a locking opening provided in each of said flaps bordering said first and second generally vertical walls at an intermediate height, and an arrangement formed on said second part of the package in the vicinity of said third and fourth generally vertical walls and cooperating with said locking openings.

11. A closed package as defined in claim 10, wherein said central zone of said second part forms a top wall of the package, said second part having two flaps bordering said top wall and forming front panels and two further flaps bordering at least partially said third and fourth generally vertical walls for holding said front panels folded internally against said third and fourth generally vertical walls, said second part also having generally triangular intermediate zones formed between said flaps forming front panel and said further flaps holding said front panel and interacting with said locking openings, said arrangement having a protruding tab extending from a respective intermediate zone.

12. A closed package as defined in claim 11, wherein each protruding tab is defined by a broken cut-out line extending between an oblique folding line separating an associated one of said further flaps which hold said front panels from said intermediate zone and a free edge of said second part of the package.

13. A closed package as defined in claim 12, wherein each of said locking openings interacting with said protruding tab is delimited by a straight edge extending generally parallel to said oblique folding line.

14. A closed package as defined in claim 13, wherein each of said locking openings is also delimited by a straight edge extending in alignment with a folding line by which said flap bordering said first and second generally vertical walls and having said locking opening is articulated on an associated part of a respective one of said generally vertical walls.

15. A closed package as defined in claim 10, wherein said central zone of said first part forms a bottom wall of the package, said second part having two further zones extending below and along said bottom wall, said locking means including locking openings formed in said bottom wall and locking tabs provided in said two further zones and cooperating with said locking openings.

16. A closed package as defined in claim 15, wherein said first part has two flaps which border said bottom wall and extend internally against a base of said third and fourth generally vertical walls.

* * * * *